US008556599B2

(12) United States Patent
Lee et al.

(10) Patent No.: US 8,556,599 B2
(45) Date of Patent: Oct. 15, 2013

(54) LINEAR COMPRESSOR

(75) Inventors: Jong-Koo Lee, Changwon-si (KR); Seong-Yeol Hyeon, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 219 days.

(21) Appl. No.: 12/739,002

(22) PCT Filed: Oct. 10, 2008

(86) PCT No.: PCT/KR2008/005994
§ 371 (c)(1),
(2), (4) Date: Aug. 11, 2010

(87) PCT Pub. No.: WO2009/054634
PCT Pub. Date: Apr. 30, 2009

(65) Prior Publication Data

US 2010/0296951 A1 Nov. 25, 2010

(30) Foreign Application Priority Data

Oct. 24, 2007 (KR) ..... 10-2007-0107380
Oct. 24, 2007 (KR) ..... 10-2007-0107386

(51) Int. Cl.
*F04B 35/04* (2006.01)
*F04B 17/04* (2006.01)

(52) U.S. Cl.
USPC ..... 417/417; 184/6.8; 184/27.4; 184/32

(58) Field of Classification Search
USPC ..... 417/417; 92/31; 184/6.8, 27.4, 32
See application file for complete search history.

(56) References Cited

U.S. PATENT DOCUMENTS 6,089,352 A 7/2000 Kim et al.
6,220,393 B1 * 4/2001 Oh et al. ..... 184/6.16
6,409,484 B1 * 6/2002 Hyun ..... 417/417
6,450,297 B1 9/2002 Kim (Continued)

FOREIGN PATENT DOCUMENTS

CN 1240255 1/2000
KR 10-0176912 10/1999

(Continued)

OTHER PUBLICATIONS

PCT International Search Report and Written Opinion dated Apr. 6, 2010 of Application No. PCT/KR2008/005994.

(Continued)

*Primary Examiner* — Devon Kramer
*Assistant Examiner* — Christopher Maxey
(74) *Attorney, Agent, or Firm* — KED & Associates LLP

(57) ABSTRACT

A linear compressor is provided. The linear compressor includes a cylinder having a refrigerant compression space inside; a piston, linearly reciprocating inside the cylinder to compress a refrigerant; a frame having the cylinder affixed at one end and a mounting groove at a lower portion; an oil feed assembly positioned in the mounting groove to supply oil; an oil supply path in a linear shape, positioned at a lower portion inside the frame to communicate with the mounting groove and with a bottom of the cylinder and which supplies oil between the cylinder and the piston; and an oil recovery path in a linear shape positioned at an upper portion inside the frame to communicate with an upper side of the frame and with a top of the cylinder and which recovers the oil between the cylinder and the piston. The oil feed assembly is in kit form.

18 Claims, 8 Drawing Sheets

(56) References Cited

U.S. PATENT DOCUMENTS

| | | | | |
|---|---|---|---|---|
| 6,491,506 | B1 * | 12/2002 | Oh et al. | 417/417 |
| 6,688,431 | B2 * | 2/2004 | Oh | 184/6.16 |
| 7,210,561 | B2 * | 5/2007 | Heo et al. | 184/6.16 |
| 7,264,451 | B2 | 9/2007 | Park | |
| 2002/0157902 | A1 * | 10/2002 | Oh | 184/6.16 |
| 2004/0057844 | A1 * | 3/2004 | Park | 417/360 |
| 2004/0104076 | A1 * | 6/2004 | Heo et al. | 184/6.16 |
| 2006/0051220 | A1 * | 3/2006 | Kwon et al. | 417/416 |
| 2006/0093495 | A1 * | 5/2006 | Oh et al. | 417/417 |
| 2006/0108880 | A1 * | 5/2006 | Lee et al. | 310/14 |
| 2006/0257275 | A1 * | 11/2006 | Park | 417/417 |
| 2007/0009370 | A1 * | 1/2007 | Kim et al. | 417/417 |
| 2007/0089768 | A1 * | 4/2007 | Glasser | 135/19 |
| 2007/0216043 | A1 * | 9/2007 | Criswell et al. | 261/76 |
| 2008/0008609 | A1 * | 1/2008 | Pate et al. | 417/415 |
| 2008/0063549 | A1 * | 3/2008 | Biscaldi et al. | 417/451 |
| 2009/0317263 | A1 * | 12/2009 | Lee | 417/53 |

FOREIGN PATENT DOCUMENTS

| | | |
|---|---|---|
| KR | 10-0239350 | 1/2000 |
| KR | 10-2001-003772 | 1/2001 |
| KR | 10-2002-0078791 | 4/2001 |
| KR | 10-2003-0082322 | 10/2003 |
| KR | 10-2004-0026711 | 4/2004 |
| KR | 10-0624734 | 9/2006 |

OTHER PUBLICATIONS

Chinese Office Action dated May 24, 2012. (with English Translation).

Korean Office Action dated Jun. 18, 2013.

Korean Office Action dated Jul. 12, 2013.

* cited by examiner

LINEAR COMPRESSOR

TECHNICAL FIELD

The present invention relates in general to a linear compressor, and more particularly, to a linear compressor featuring enhanced oil feed performance through an improved oil circulation path.

Moreover, the present invention relates to a linear compressor including an oil feed assembly that can be manufactured and assembled in kit form.

BACKGROUND ART

In general, a reciprocating compressor is designed to form a compression space to/from which an operation gas is sucked/discharged between a piston and a cylinder, and the piston linearly reciprocates inside the cylinder to compress refrigerants.

Most reciprocating compressors today have a component like a crankshaft to convert a rotation force of a drive motor into a linear reciprocating drive force for the piston, but a problem arises in a great mechanical loss by such motion conversion. To solve the problem, development of linear compressors is still under progress.

Linear compressors have a piston that is connected directly to a linearly reciprocating linear motor, so there is no mechanical loss by the motion conversion, thereby not only enhancing compression efficiency but also simplifying the overall structure. Moreover, since their operation is controlled by controlling an input power to a linear motor, they are much less noisy as compared to other compressors, which is why linear compressors are widely used in indoor home appliances such as a refrigerator.

FIG. 1 illustrates one example of a linear compressor in accordance with a prior art.

The conventional linear compressor has an elastically supported structure inside a shell (not shown), the structure including a frame 1, a cylinder 2, a piston 3, a suction valve 4, a discharge valve assembly 5, a linear motor 6, a motor cover 7, a supporter 8, a body cover 9, mainsprings S1 and S2, a muffler assembly 10, and an oil feeder 20.

The cylinder 2 is insertedly fixed to the frame 1, and the discharge assembly 5 constituted by a discharge valve 5*a*, a discharge cap 5*b*, and a discharge valve spring 5*c* is installed to cover one end of the cylinder 2. The piston 3 is inserted into the cylinder 2, and the suction valve 4 which is very thin is installed to open or close a suction port 3*a* of the piston 2.

The linear motor 6 is installed in a manner that a permanent magnet 6*c* linearly reciprocates while maintaining the air-gap between an inner stator 6*a* and an outer stator 6*b*. To be more specific, the permanent magnet 6*c* is connected to the piston 3 with a connecting member 6*d*, and an interactive electromagnetic force between the inner stator 6*a*, the outer stator 6*b*, and the permanent magnet 6*c* makes the permanent magnet 6*c* linearly reciprocating to actuate the piston 3.

The motor cover 7 supports the outer stator 6*b* in an axial direction to fix the outer stator 6*b* and is bolted to the frame 1. The body cover 9 is coupled to the motor cover 7, and between the motor cover 7 and the body cover 9 there is the supporter 8 that is connected to the other end of the piston 3, while being elastically supported in an axial direction by the mainsprings S1 and S2. The muffler assembly 10 for sucking in refrigerant is also fastened to the supporter 8.

Here, the mainsprings S1 and S2 consist of four front springs S1 and four rear springs S2 that are arranged in horizontally and vertically symmetrical positions about the supporter 8. As the linear motor 6 starts running, the front springs S1 and the rear springs S2 move in opposite directions and buff the piston 3 and the supporter 8. In addition to these springs, the refrigerant in the compression space P functions as sort of a gas spring to buff the piston 3 and the supporter 8.

The oil feeder 20 includes an oil feed pipe 21, an oil pump 22, and an oil valve assembly 23, and is configured to communicate with an oil circulation path (not shown) that is formed in the frame 1.

Therefore, when the linear motor 6 starts running, the piston 3 and the muffler assembly 10 connected thereto linearly reciprocate together, and the operation of the suction valve 4 and the discharge valve assembly 5 are controlled automatically with variations in pressure of the compression space P. Through this operation mechanism, refrigerant is sucked into the compression space P after travelling through the suction pipe on the side of the shell, the opening in the back cover 9, the muffler assembly 10, and the suction ports 3*a* in the piston, is compressed, and then escapes to the outside via the discharge cap 5*b*, a loop pipe L, and an outflow pipe on the side of the shell.

FIG. 2 illustrates one example of an oil circulation path adapted to a linear compressor in accordance with a prior art. The oil circulation path in a conventional linear compressor is divided into an oil supply path 1in that is formed at a lower, inner portion of the frame 1 and an oil recovery path 1out that is formed at an upper, inner portion of the frame 1. For convenience sake, the oil supply path 1in and the oil recovery path 1out are manufactured in same size and have the same position and the same angle at the upper and lower portions of the frame 1. To be more specific, the oil supply path 1in and the oil recovery path 1out have the same diameter, and an angle A between the oil supply path 1in and the central axis of the cylinder 2 is same as an angle B between the oil recovery path 1out and the central axis of the cylinder 2. Here, the oil supply path 1in is inclinedly positioned to communicate with a portion of the lower side of the frame 1 where the oil valve assembly 23 (see FIG. 1) is mounted and to communicate with the bottom of the cylinder 2. Also, the oil recovery path 1out is inclinedly positioned to communicate with the top of the cylinder 2 and to be exposed to a portion on the top of the frame 1.

When vibrations generated from the linear reciprocating motion of the piston 3 are transmitted to the oil pump 22, a pressure difference is created by the oil pump 22 and by the pressure difference oil at the bottom of the shell is pumped via the oil feed pipe 21 (see FIG. 1). The pumped oil flows along the oil feed pipe 21 (see FIG. 1), the oil valve assembly 23 (see FIG. 1), and the oil supply path 1in, and then is fed between the cylinder 2 and the piston 3 to lubricate/cool them. Thereafter, the oil passes through the oil recovery path 1out and flows down along one side of the frame 1 to be collected at the bottom of the shell.

In the case of the conventional linear compressor, the oil circulation paths of the same size are formed at the top and bottom of the at the same angle, so it is relatively easy to manufacture them. However, as the design degrees of freedom are lowered, the oil feed performance is restricted, and the operation reliability is deteriorated due to imbalances on feed.

Moreover, in the case of the conventional linear compressor, the oil feed pipe and the oil pump are mounted on one side of the frame, while the oil valve assembly that communicates with the oil feed pipe and the oil pump is mounted on the other side of the frame. Thus, even though oil is fed while flowing through the oil feed pipe, the bottom of the oil valve assembly, the oil pump, the top of the oil valve assembly, and the oil supply path, since the path communicating with the oil feed pipe inside the frame, the path communicating with the oil pump, and the oil supply path are formed separately, not only the entire path becomes long, but also the feed performance is impaired by resistance in the path.

As noted earlier, when the linear motor 6 shown in FIG. 1 starts running, the piston 3 and the muffler assembly 10 connected thereto linearly reciprocate together, and the operation of the suction valve 4 and the discharge valve assembly 5 are controlled automatically with variations in pressure of the compression space P encourage the suction valve 4. Through this operation mechanism, refrigerant is sucked into the compression space P after travelling through the suction pipe on the side of the shell, the opening in the body cover 9, the muffler assembly 10, and the suction ports 3*a* in the piston, is compressed, and then escapes to the outside via the discharge cap 5*b*, a loop pipe, and an outflow pipe on the side of the shell.

As the piston 3 linearly reciprocates, vibrations are created, and the vibrations cause the oil piston to linearly reciprocate inside the oil pump 22, thereby producing a pressure difference and making oil on the bottom of the shell pump through the oil feed pipe 21. When the oil suction valve and the oil discharge valve are open and closed, the oil passes through the oil valve assemblies 23 and 30 (see FIG. 3) to circulate along the oil circulation path and is recovered back to the bottom of the shell. This circulating oil serves to lubricate/cool the components like the cylinder 2, the piston 3, and so on.

FIG. 3 illustrates one example of an oil valve assembly in a linear compressor in accordance with a prior art. In one example, a conventional oil valve assembly 30 is mounted on one side of a frame (not shown) to communicate with an oil circulation path (not shown) that is formed in the frame, and includes a plate type oil valve 32 in which an oil suction valve 32*a* and an oil discharge valve 32*b* for discharging oil are openably/closeably formed, a gasket 34 which is installed to touch a peripheral rim portion of one side of the oil valve 32 that comes in contact with a frame (not shown), so as to prevent an oil leakage, an oil seat 36 which is installed to touch the other side of the oil valve 32 in opposite direction, so as to form a temporary oil storage space, and an oil cover 38.

For the oil valve assembly 30 with the above configuration, the gasket 34, the oil valve 32, the oil seat 36, and the oil cover 38 are laminated in order of mention, and the laminate structure is then screwed to the frame, while the gasket 34 is being adhered closely to the other side of the frame. Of course, the oil suction valve 32*a* and the oil discharge valve 32*b* are positioned to communicate with the storage space, and they are either opened or closed depending on an internal pressure of the oil cylinder 32, the storage, and the oil circulation path (not shown), thereby allowing a predetermined amount of oil to flow.

However, in the case of the oil feeder for the conventional linear compressor, the oil feed pipe, the oil pump, and the oil valve assembly, which serve as the oil pumping/circulating mechanism, must be assembled separately or individually. Consequently, there are so many components to work on, and their assembly process is complicate and inconvenient. Furthermore, in some cases oil feed performance is tested after the oil feed pipe, the oil pump, and the oil valve assembly were all assembled to the frame side, but one cannot easily detect, during the production, if there is any defect in the performance of oil feed. This in turn increases defect rate and fails to guarantee good operation reliability.

Besides, in the case of the oil feeder for the conventional linear compressor, the oil valve assembly for opening/closing the oil supply path is made in kit form which includes a gasket, an oil valve, an oil seat, and an oil cover as discussed earlier. However, problems associated with the large number of components to work on and the complicate assembly process still remain unsolved. In addition, bolt joints get weaker after a long period of use, so an oil leakage occurs and operation reliability is degraded.

DISCLOSURE OF INVENTION

Technical Problem

The present invention is conceived to solve the aforementioned problems in the prior art. An object of the present invention is to provide a linear compressor featuring an improved oil circulation path through which oil circulates, such that oil feed performance can be improved and feed path can be shortened.

Another object of the present invention is to provide a linear compressor including an oil feed assembly, components of which being involved in oil pumping/circulating can be manufactured and assembled in kit form.

Technical Solution

According to an aspect of the present invention, there is provided a linear compressor, comprising: a cylinder having a refrigerant compression space inside; a piston, which linearly reciprocates inside the cylinder to compress refrigerant; a frame, to which one end of the cylinder is affixed and which has a mounting groove at a lower portion; an oil feed assembly settled in the mounting groove of the frame, for pumping/supplying oil; an oil supply path in a linear shape, which is positioned at a lower portion inside the frame to communicate with the mounting groove of the frame and with the bottom of the cylinder and which supplies oil between the cylinder and the piston; and an oil recovery path in a linear shape, which is positioned at an upper portion inside the frame asymmetrically to the oil supply path to communicate with an upper side of the frame and with the top of the cylinder and which recovers oil between the cylinder and the piston.

In one embodiment of the present invention, an angle between the oil supply path and a central axis of the cylinder is greater than an angle between the oil recovery path and the central axis of the cylinder.

In one embodiment of the present invention, the oil supply path is greater in diameter than the oil recovery path.

In one embodiment of the present invention, the oil recovery path is shorter than the oil supply path.

Another aspect of the present invention provides an linear compressor, comprising: a cylinder having a refrigerant compression space inside; a piston, which linearly reciprocates inside the cylinder to compress refrigerant; a frame, to which one end of the cylinder is affixed and which has a mounting groove at a lower portion; an oil feed assembly settled in the mounting groove of the frame, for pumping/supplying oil; and an oil supply path in a linear shape, which is positioned at a lower portion inside the frame to communicate with the mounting groove of the frame and with the bottom of the cylinder and which supplies oil between the cylinder and the piston.

In one embodiment of the present invention, the oil feed assembly adapted to a linear compressor includes: an oil piston, which has a penetrating axial oil path and which pumps oil while making a linear-reciprocating motion; first and second oil springs for elastically supporting both ends of the oil piston in an axial direction; and a casing, which is constituted by a first member with an inlet through which oil is introduced and a second member with an outlet through which oil is discharged, the first and second members being assembled to communicate with each other while the oil piston and the first and second oil springs are already built in.

In a linear compressor with the oil feed assembly according to the present invention, the first and second members are assembled in an axial direction.

In a linear compressor with the oil feed assembly according to the present invention, one of the first and second members has a male thread on the outer circumference, and the other of the first and second members has a female thread on the inner circumference to be engagedly coupled with the male thread.

In a linear compressor with the oil feed assembly according to the present invention, one of the first and second members has a mounting protrusion on the outer circumference, and the other of the first and second members has a mounting groove on the inner circumference to be engagedly coupled with the mounting protrusion.

In a linear compressor with the oil feed assembly according to the present invention, the first and second members are made of plastic materials.

In a linear compressor with the oil feed assembly according to the present invention, a friction member is further includes, the friction member being affixed to the inner circumference of the casing so as to reduce friction/abrasion of the casing against the linear reciprocating motion of the oil piston therein.

In a linear compressor with the oil feed assembly according to the present invention, the oil piston has friction-decreasing grooves that are formed in one section of the outer circumference, so as to reduce a contact area with the casing during its linear reciprocating motion.

In another embodiment of the present invention, the oil feed assembly includes: a plastic casing, which has an inlet and an outlet on both sides for introducing and discharging oil therethrough; an oil piston, which is seated inside the casing and pumps oil while making a linear reciprocating motion and which has a penetrating axial oil path; first and second oil springs for elastically supporting both ends of the oil piston on the inside of the inlet/outlet of the casing; and a friction member affixed to the inner circumference of the casing, for reducing friction/abrasion of the casing against the linear reciprocating motion of the oil piston therein.

In a linear compressor with the oil feed assembly according to the present invention, the casing is constituted by a first member with an inlet through which oil is introduced and a second member with an outlet through which oil is discharged, wherein the first and second members are assembled to communicate with each other while the oil piston and the first and second oil springs are already built in.

In a linear compressor with the oil feed assembly according to the present invention, the first and second members are assembled in an axial direction.

In a linear compressor with the oil feed assembly according to the present invention, one of the first and second members has a male thread on the outer circumference, and the other of the first and second members has a female thread on the inner circumference to be engagedly coupled with the male thread.

In a linear compressor with the oil feed assembly according to the present invention, one of the first and second members has a mounting protrusion on the outer circumference, and the other of the first and second members has a mounting groove on the inner circumference to be engagedly coupled with the mounting protrusion.

In a linear compressor with the oil feed assembly according to the present invention, the oil piston has friction-decreasing grooves that are formed in one section of the outer circumference, so as to reduce a contact area with the casing during its linear reciprocating motion.

In yet another embodiment of the present invention, the oil feed assembly includes: a casing made of a plastic material, which is constituted by a first member with an inlet through which oil is introduced and a second member with an outlet through which oil is discharged, the first and second members being assembled to each other; an oil piston made of a metallic material, which pumps oil while making a linear-reciprocating motion and which has a penetrating axial oil path and; first and second oil springs for elastically supporting both ends of the oil piston on the inside of the inlet/outlet of the casing; an oil suction valve in sheet metal form, which is elastically supported by the first oil spring to open or close the inlet of the casing; an oil discharge valve in sheet metal form, which is elastically supported by the second oil spring to open or close the outlet of the casing; and a friction member affixed to the inner circumference of the casing, for reducing friction/abrasion of the casing against the linear reciprocating motion of the oil piston therein.

Advantageous Effects

In a linear compressor with the above-described configuration in accordance with the present invention, the oil supply path has a linear shape to be communicable directly with the oil feed assembly that is mounted at the lower portion of the frame, and the oil recovery path also has a linear shape, although asymmetrical with the oil supply path, formed at the upper portion of the frame, such that both the oil supply and recover paths can be shortened and designed more freely. Consequently, the oil feed performance is improved and further, the operation reliability is enhanced through a smooth supply of oil.

The linear compressor including the oil feed assembly in accordance with the present invention is manufactured in kit form, providing a plastic casing that is obtained by joining two members to accommodate an oil piston, oil springs, and oil suction/discharge valves therein. In this manner, the number of components is reduced and the overall configuration is simplified, thereby cutting the production cost. Moreover, since the oil feed performance can be tested during the production, defect rates are lowered accordingly.

The linear compressor including the oil feed assembly in accordance with the present invention further includes a separate friction member to reduce friction between the casing and the oil piston, or friction-decreasing grooves to reduce a contact area between the casing and the oil piston. As such, plastic materials can be utilized to make the casing of diverse shapes, and production costs are accordingly reduced by the use of plastic materials.

Because the linear compressor including the oil feed assembly in accordance with the present invention is installed between the frame and the motor cover concurrently with the assembly of the two, the overall assembly process is simplified and its mass productivity increases.

Moreover, after the linear compressor including the oil feed assembly in accordance with the present invention is manufactured in kit form, the oil feed performance is tested before the linear compressor is installed between the frame and the motor cover. In so doing, defect rates in the supply of oil can be lowered and the operation reliability is improved.

MODE FOR THE INVENTION

Hereinafter, preferred embodiments of the present invention will be described in detail with reference to the accompanying drawings.

Figure 1:
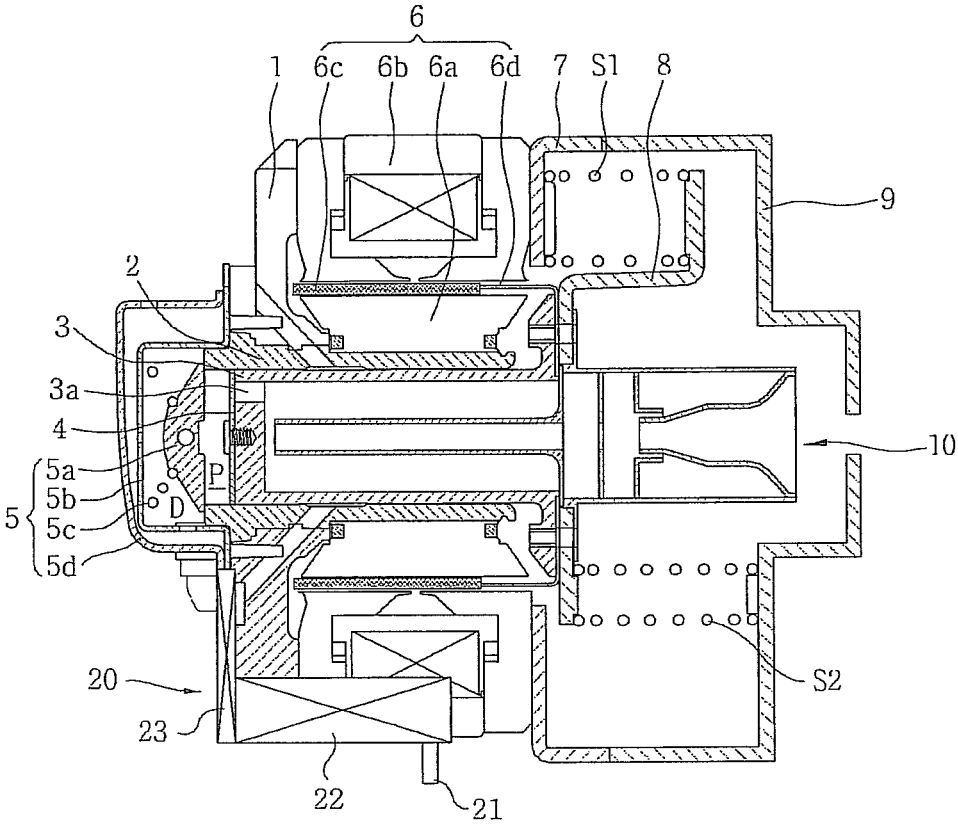
Fig. 1 Prior Art
FIG. 1 illustrates one example of a linear compressor in accordance with a prior art.
Figure 2:
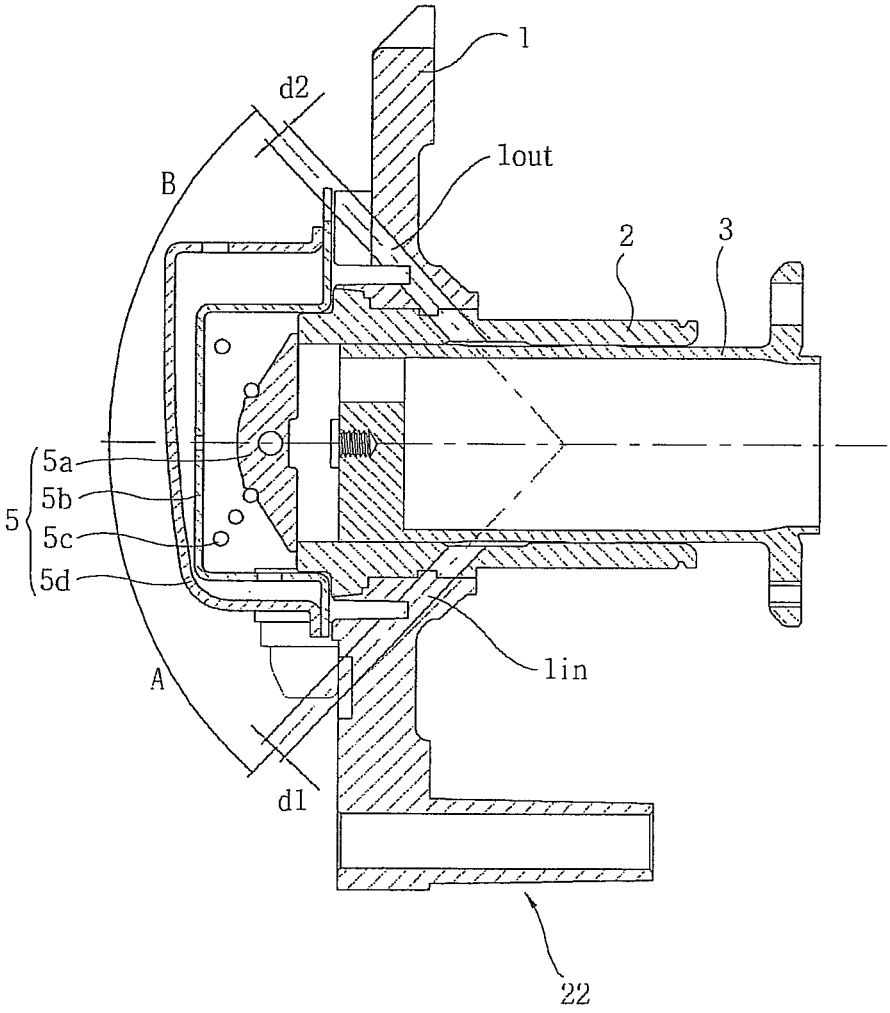
Fig. 2 Prior Art
FIG. 2 illustrates one example of an oil circulation path for a linear compressor in accordance with a prior art.
Figure 3:
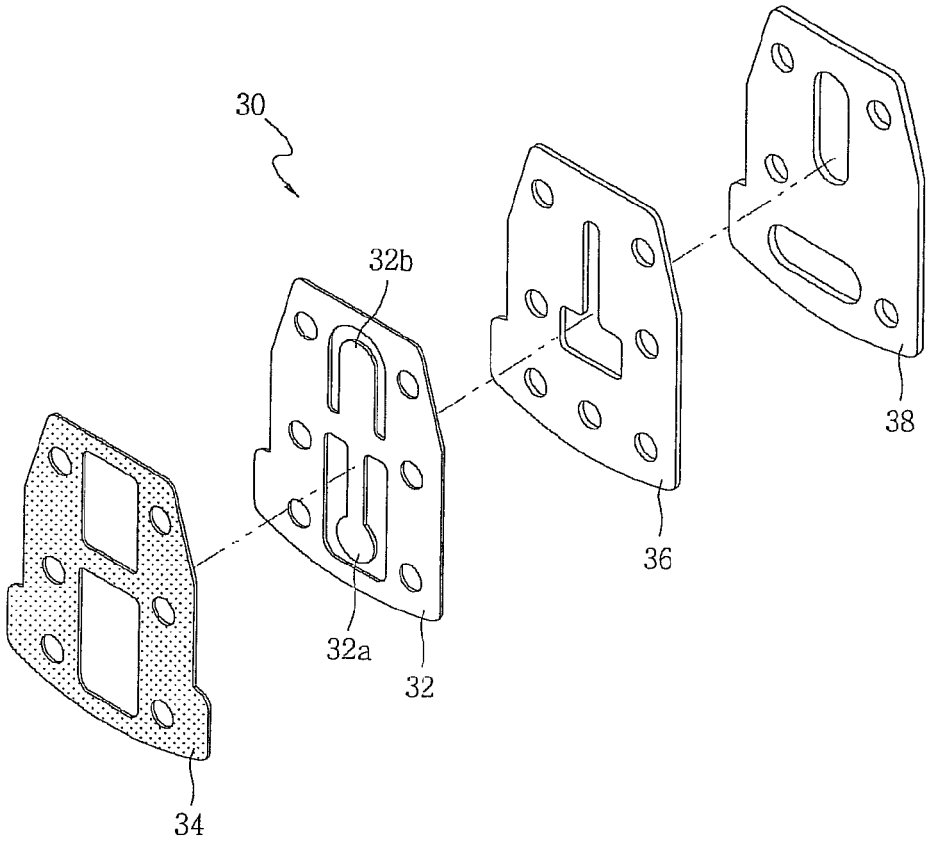
Fig. 3 Prior Art
FIG. 3 illustrates one example of an oil valve assembly for a linear compressor in accordance with a prior art.
Figure 4:
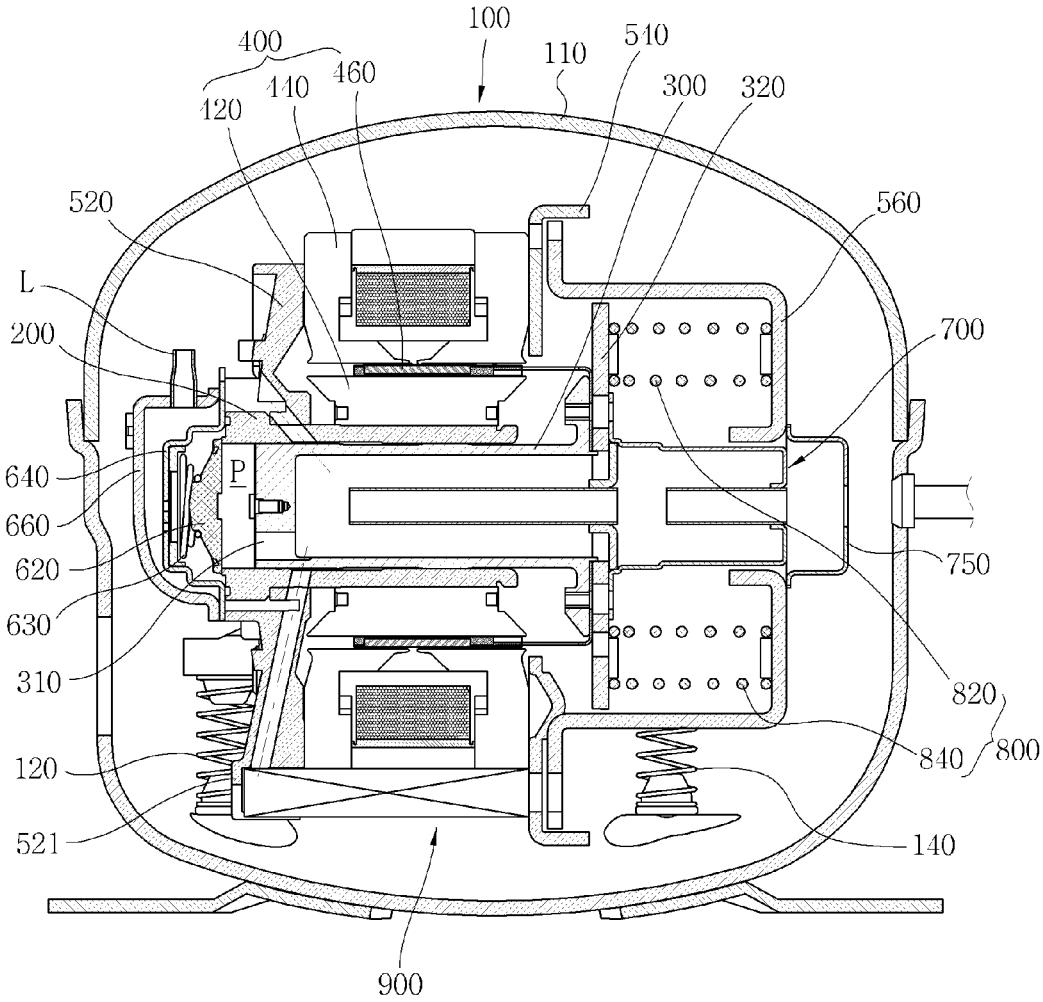
FIG. 4 illustrates one example of a linear compressor in accordance with the present invention.

FIG. 4 illustrates one example of a linear compressor in accordance with the present invention.

In one example, a linear compressor 100 of the present invention includes, in a shell 110 used as a hermetic container, a cylinder 200, a piston 300, a linear motor 400 having an inner stator 420, an outer stator 440, and a permanent magnet 460, and an oil feed assembly 900. When the permanent magnet 460 starts a linear reciprocating motion by an interactive electromagnetic force between the inner stator 420 and the outer stator 440, the piston 300 operationally coupled to the permanent magnet 460 also linearly reciprocates. Through vibrations of the piston 300, the oil at the bottom of the shell 110 is pumped/supplied through the oil feed assembly 900, lubricating (and cooling) the cylinder 200 and the piston 300 in the course of its circulation.

The inner stator 420 is fixed to an outer periphery of the cylinder 200, and the outer stator 440 is secured axially by a frame 520 and a motor cover 540. The frame 520 and the motor cover 540 are joined together by fastening members such as bolts, and the outer stator 440 is secured between the frame 520 and the motor cover 540. The frame 520 may be integrally formed with the cylinder 200, or the frame 520 may be manufactured separately and then coupled to the cylinder 200 later. The embodiment in FIG. 4 shows an example where the frame 520 and the cylinder 200 are integrated as one body.

The supporter 320 is connected to the rear side of the piston 300. Four front main springs 820 are supported on both ends by the supporter 320 and the motor cover 540. Also, four rear mainsprings 840 are supported on both ends by the supporter 320 and a back cover 560, and the back cover 560 is coupled to the rear side of the motor cover 540. A suction muffler 700 is provided on the rear side of the piston 300, through which refrigerant flows into the piston 300, so less noise is generated during suction feeding.

The interior of the piston 300 is hollowed to let the refrigerant which is fed through the suction muffler 700 introduced and compressed in a compression space P defined between the cylinder 200 and the piston 300. A suction valve 310 is seated at the front end of the piston 300. The suction valve 310 in the open position allows the refrigerant to flow from the piston 300 into the compression space P, and it shuts the front end of the piston 300 to prevent backflow of the refrigerant from the compression space P to the piston 300.

When refrigerant inside the compression space P is compressed to a predetermined level or higher, it causes a discharge valve 620 which is seated at the front end of the cylinder 200 to open. The discharge valve 620 is elastically supported by a spiral discharge valve spring 630 inside a support cap 640 that is secured to one end of the cylinder 200. The high-pressure compressed refrigerant is then discharged into a discharge cap 660 via a hole which is formed in the support cap 640, and then escapes from the linear compressor 100 via a loop pipe L to be circulated, thereby making the refrigeration cycle work.

The oil feed assembly 900 is manufactured in kit form which is supportably installed in an axial direction between a mounting groove 521 of the frame and the motor cover 540. Needless to say, a certain elastic member (not shown) such as leaf spring may be inserted in order to increase connection force at the time of installation of the oil feed assembly 900. The oil feed assembly 900 is installed to communicate with an oil circulation path (not shown) that is provided inside the frame 520, such that oil can be supplied between the cylinder 200 and the piston 300. In short, when the piston 300 makes a linear reciprocating motion, vibrations are created. These vibrations are transferred to the oil feed assembly 900 to make it work, and the oil feed assembly 900 in operation then pumps/circulates the oil that has been stored at the bottom of the shell 110.

Figure 5:
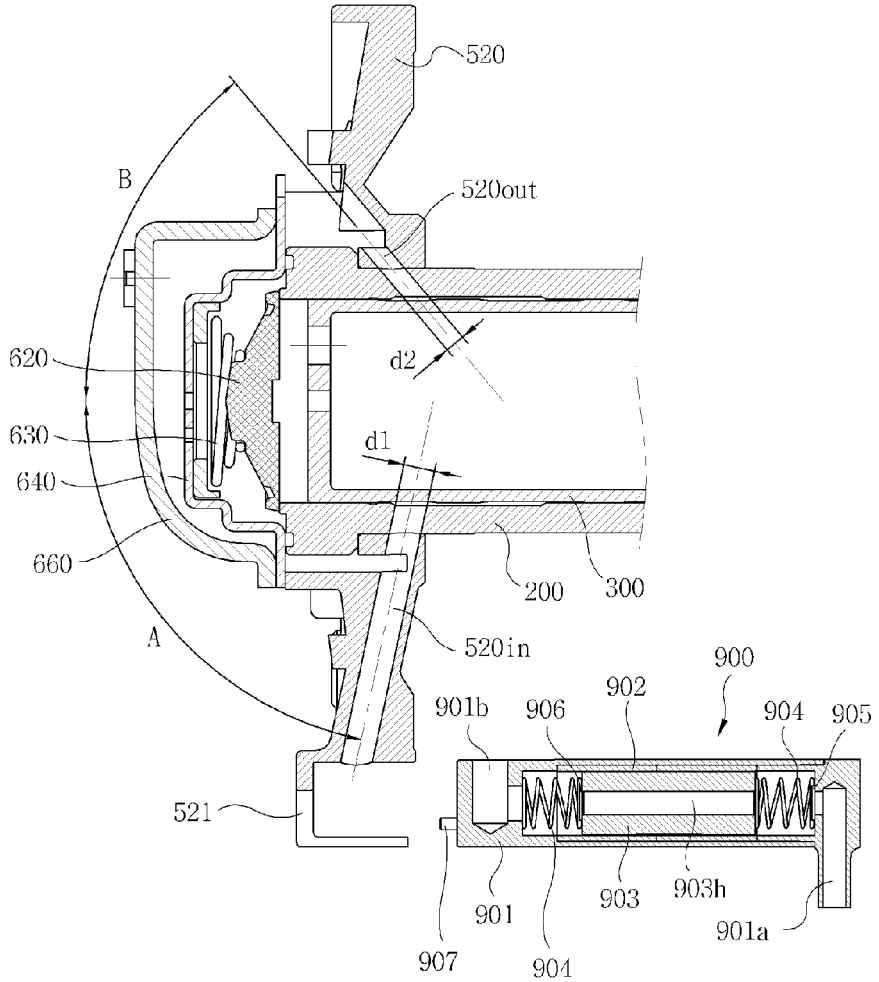
FIG. 5 illustrates one example of an oil circulation path for a linear compressor in accordance with the present invention.

FIG. 5 illustrates one example of an oil circulation path for a linear compressor in accordance with the present invention. The oil circulation path in a linear compressor of the present invention includes a mounting groove 521 where an oil feed assembly 900 (see FIG. 4) is seated at a lower portion of the frame 520, an oil supply path 520in of a linear shape located at the inside of a lower portion of the frame 520 to be able to communicate with the mounting groove 521, and an oil recovery path 520out of a linear shape located at the inside of an upper portion of the frame 520. To improve the oil feed performance, the oil supply path 520in and the oil recovery path 520out are arranged at different positions and different angles on the upper and lower portions of the frame 520.

In detail, the oil supply path 520in is formed at the inside of a lower portion of the frame 520, making an upward slanted line from the mounting groove 521 to a lower air-gap between the cylinder 200 and the piston 300. Similarly, the oil recovery path 520out is formed at the inside of an upper portion of the frame 520, making a downward slanted line from an upper side of the frame 520 to an upper air-gap between the cylinder 200 and the piston 300. Consequently, this structural feature makes the flow path of oil shorter, thereby improving the oil feed performance.

Moreover, diameter d1 of the oil supply path 520in is larger than diameter d2 of the oil recovery path 520out. That is, the oil supply path 520in is preferably made wide in order to reduce resistance in the oil path at the early phase, while the oil recovery path 520out is preferably made narrow in order to let oil quickly get out even if the pumping force of oil is weakened due to the resistance in the path.

In addition, an angle A between the oil supply path 520in and the central axis of the cylinder 200 is greater than an angle B between the oil recovery path 520out and the central axis of the cylinder 200, such that the length of the oil recovery path 520out is made shorter than the length of the oil supply path 520in. Since a full range of the pumping force tends to be applied at the early phase, it is not a serious problem even though the oil supply path 520in is long. Meanwhile, considering that the pumping force of oil gets weaker because of the resistance in the path, the oil recovery path 520out through which oil escapes should be made short.

Of course, the oil feed performance can be improved by configuring the oil supply path 520in and the oil recovery path 520out in various positions, angles, sizes, etc. These variations can easily be achieved by giving different input values to the equipment that is used for forming the oil supply path 520in and the oil recovery path 520out in the frame 520 at the early stage of the manufacture.

Since the oil supply path 520in communicates with the mounting groove 521 of the frame 520 where the oil feed assembly 900 is mounted, an oil feed path of a shorter length is more appreciated. Here, the mounting groove 521 is formed to have its open side at the lower end of the frame 520, and the oil feed assembly 900 is insertedly fitted in an axial direction from the open side of the frame 520into the mounting groove 521.

More specifically, in one example, the oil feed assembly 900 is manufactured in kit form, providing an casing 901 to accommodate a friction member 902, a piston 903, a pair of oil springs 904, an oil suction valve 905, and an oil discharge valve 906 inside.

The casing 901 takes the form of a hollow shaft, and has inlet/outlet 901*a* and 901*b* to let refrigerant in/out through them. The inlet 901*a* with a pipe shape is located at a lower portion of one end, while the outlet 901*b* is located at an upper portion of the other end. The inlet path, the internal space path, and the outlet path are interconnected to each other, while being bent 90 degrees at joints. Needless to say, when the casing 901 is seated at the mounting groove 521 of the frame 520, the outlet 901*b* of the casing 901 is communicated with the oil supply path 520 in of the frame 520. The casing 901 may be formed in diverse shapes, and is made out of plastic materials to cut down the production cost. To accommodate all of the friction member 902, the oil piston 903, the oil springs 904, the oil suction valve 905, and the oil discharge valve 906 inside, the casing 901 is constituted by at least two members that are integrated together in kit form. For example, a pipe with an inlet 901*a* may be manufactured first separately from the casing body. Next, all the components mentioned above are built in the casing body. Lastly, the pipe with the inlet is fastened to the casing body.

The friction member 902 is a kind of bush that is installed along the inner circumference of the casing 901. It is provided to reduce the friction/abrasion of the plastic casing 901 against the continuous linear reciprocating motion of the metallic oil piston 903. Of course, the friction member 902 in a hollow shaft form may be installed at only a part of the casing 901 to cover the linear reciprocating distance, i.e., the stroke, of the oil piston 903. The oil piston 903 linearly reciprocates inside the friction member 902, and there is a penetrating axial hole 903*h* at the center to pass oil.

The oil springs 904 elastically support both ends of the oil piston 903 in the axial direction inside the casing 901. One oil spring 904 is supportably affixed to the inlet 901*a* of the casing, a stepped portion of the internal space, and one end of the oil piston 903, while the other oil spring 904 is supportably affixed to the other end of the oil piston 903, the internal space of the casing 901, and a stepped portion of the outlet 901*b*.

The oil suction valve 905 is installed at the inlet of the casing 901 and the stepped portion of the internal space, and the oil discharge valve 906 is installed at one end of the hole 903*h* of the oil piston 903 through which refrigerant having passed through the oil piston 903 escapes. Similar to the suction valve 310 (see FIG. 4), the oil suction/discharge valves 905 and 906 are manufactured in a sheet metal form, and they each have a spiral-shaped section on the inner face, by which the valves are either opened or closed depending on the refrigerant pressure. As outer circumferential ends of both the oil suction valve 905 and the oil discharge vale 906 are supported by the oil springs 904, the center portion of each of the valves is opened or closed to adjust oil supply.

Besides, the oil feed assembly 900 is provided with an anti-rotation protrusion 907 to prevent the assembly from rotating after it is positioned in the mounting groove 521 of the frame 520, and the mounting groove 521 of the frame can also have an anti-rotation groove (not shown) correspondingly to the anti-rotation protrusion 907.

The following will now explain how oil circulates in a linear compressor having the above-described configuration. When vibrations that are produced in result of the linear-reciprocating motion of the piston 300 are transferred to the oil feed assembly 900 (see FIG. 4), a balance of pressure inside the oil feed assembly 900 (see FIG. 4) breaks and the oil at the bottom of the shell 110 (see FIG. 4) is pumped through the oil feed assembly 900 (see FIG. 4) through the pressure difference. The thusly pumped oil then flows along the oil supply path 520in and is supplied between the cylinder 200 and the piston 300, thereby lubricating and cooling them. Next, the oil passes through the oil recovery path 520out and flows down along one side of the frame 520 to be collected at the bottom of the shell 110 (see FIG. 4).

As discussed earlier, the oil supply path 520 in is relatively wide to reduce resistance in the path for the sake of oil flow, while the oil recovery path 520out is relatively narrow and short at the same time to let the oil be discharged quickly even if the pumping forces has weakened due to the resistance in the path. Overall, the oil feed performance is improved and the friction/abrasion of a contact region between the cylinder 200 and the piston 300 is reduced, thereby improves the performance reliability.

In addition, because the pumped oil through the oil feed assembly 900 is fed immediately via the linear-shaped oil supply path 520in of the frame 520, the oil feed path from the oil feed assembly 900 to an air-gap between the cylinder 200 and the piston 300 can be shortened. This also improves the oil feed performance.

Meanwhile, in relation to FIG. 4, each component of the linear compressor 100 discussed before are supported, in assembled state, by a front support spring 120 and a rear support spring 140, and they are spaced apart from the bottom of the shell 110. Because they are not in direct contact with the bottom of the shell 110, vibrations produced from each component of the compressor 100 during the compression of refrigerant are not transferred directly to the shell 110. Therefore, it becomes possible to reduce vibrations being transferred to the outside of the shell 110 and noise produced by vibrations of the shell 110.

Figure 6:
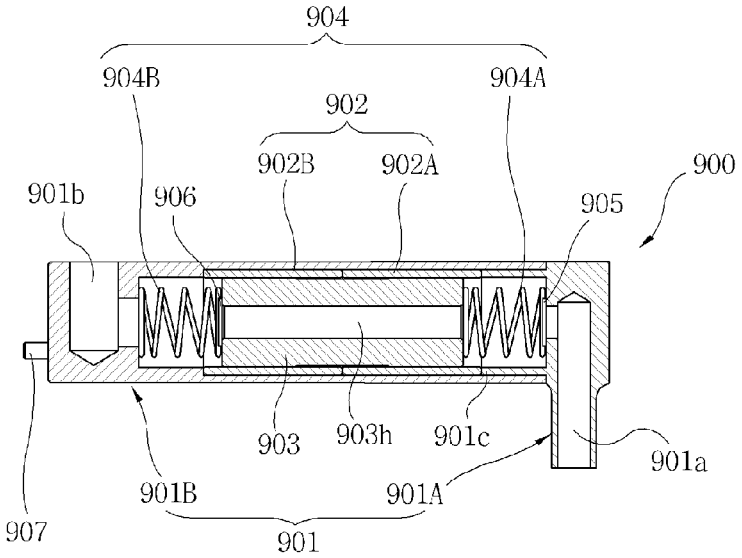
FIGS. 6 and 7 each illustrate one example of an oil feed assembly for a linear compressor in accordance with the present invention.
Figure 7:
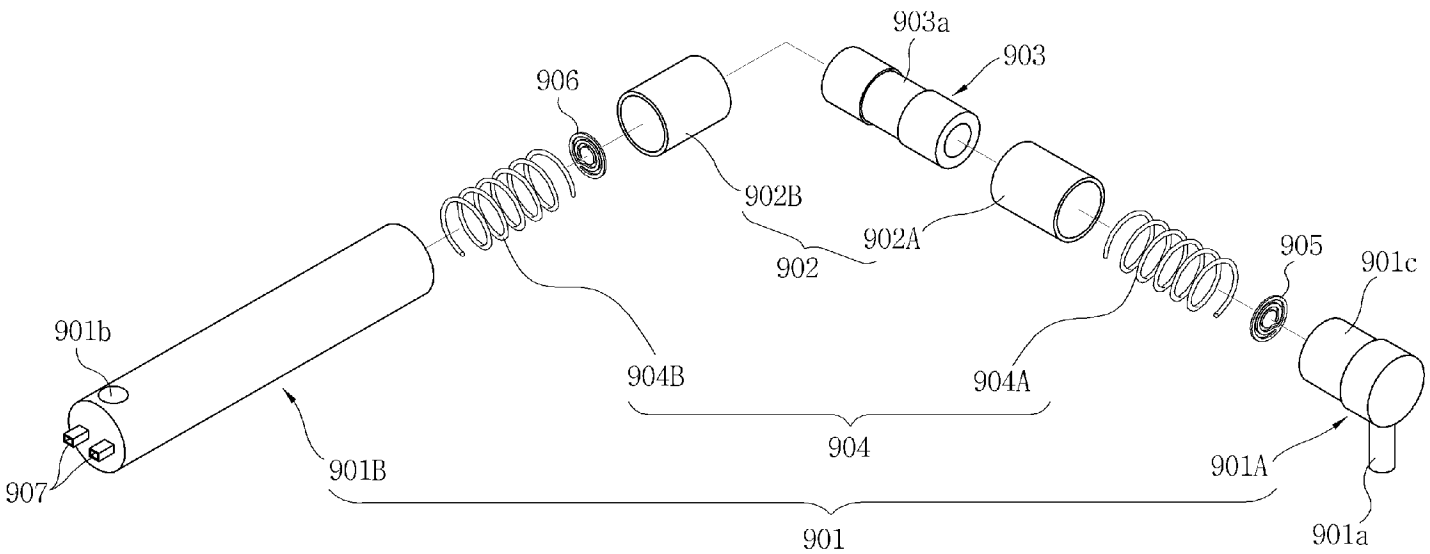

FIG. 6 and FIG. 7 each illustrate one example of an oil feed assembly in a linear compressor in accordance with the present invention. In one example, an oil feed assembly 900 is manufactured in kit form, providing a plastic casing 901 to accommodate a friction member 902, a piston 903, a pair of oil springs 904, an oil suction valve 905, and an oil discharge valve 906 inside.

The casing 901 takes the form of a hollow shaft, and has inlet/outlet 901*a* and 901*b* to let refrigerant in/out through them. The inlet 901*a* with a pipe shape is located at a lower portion of one end, while the outlet 901*b* is located at an upper portion of the other end. The inlet path, the internal space path, and the outlet path are interconnected to each other, while being bent 90 degrees at joints. Needless to say, when the casing 901 is seated at the mounting groove 521 of the frame 520, the outlet 901*b* of the casing 901 is communicated with the oil supply path 520 in of the frame 520. The casing 901 may be formed in diverse shapes, and is made out of plastic materials to cut down the production cost. To accommodate all of the friction member 902, the oil piston 903, the oil springs 904, the oil suction valve 905, and the oil discharge valve 906 inside, the casing 901 is constituted by at least two members, first and second members 901A and 901B, that are integrated together. For example, the first and second members 901A and 901B are manufactured separately from a suction pipe 901A with an inlet 901*a* and from a cylindrical casing body 901B. Next, all the components mentioned above are built in the casing body 901B, and then the suction pipe 901A with the inlet 901*a* is communicably assembled at the casing body. Here, the suction pipe 901A has a stepped structure with a decreasing outer diameter on one end, and the casing body 901B to be coupled therewith also has a stepped structure with an increasing inner diameter on one end. As such, the suction pipe 901A and the casing body 901B are press-fit together and assembled to each other in the axial direction.

The friction member 902 is a kind of bush that is installed along the inner circumference of the casing 901. It is provided to reduce the friction/abrasion of the plastic casing 901 against the continuous linear reciprocating motion of the metallic oil piston 903. Of course, the friction member 902 in a hollow shaft form may be installed at only a part of the casing 901 to cover the linear reciprocating distance, i.e., the stroke, of the oil piston 903. To facilitate the assembly of the casing 901 and the oil piston 903 in the axial direction, the friction member 902 can be divided into two members 902A and 902B. When the first and second members 901A and 901B are assembled to build the casing 901, the friction members 902A and 902B are also fixed in the axial direction inside the casing 901.

The oil piston 903 linearly reciprocates inside the friction member 902 and has a penetrating axial hole 903*h* at the center to pass oil. In order to reduce a contact area between the oil piston 903 and the friction member 902, a friction-decreasing groove 903*a* is formed in some part of the outer circumference of the oil piston 903. Now that the friction-decreasing groove 903*a* in the oil piston 903 serves to reduce frictional resistance, the friction member 902 may not be provided and the casing 901 and the oil piston 903 may come in direct contact with each other.

The oil springs 904 elastically support both ends of the oil piston 903 in the axial direction inside the casing 901. A first oil spring 904A is supportably affixed to the inlet 901*a* of the casing, a stepped portion of the internal space, and one end of the oil piston 903, while a second oil spring 904B is supportably affixed to the other end of the oil piston 903, the internal space of the casing 901, and a stepped portion of the outlet 901*b*.

The oil suction valve 905 is installed at the inlet of the casing 901 and the stepped portion of the internal space, and the oil discharge valve 906 is installed at one end of the hole 903*h* of the oil piston 903 through which refrigerant having passed through the oil piston 903 escapes. Similar to the suction valve 310 (see FIG. 4), the oil suction/discharge valves 905 and 906 are manufactured in a sheet metal form, and they each have a spiral-shaped section on the inner face, by which the valves are either opened or closed depending on the refrigerant pressure. As outer circumferential ends of both the oil suction valve 905 and the oil discharge vale 906 are supported by the oil springs 904, the center portion of each of the valves is opened or closed to adjust oil supply.

Figure 8:
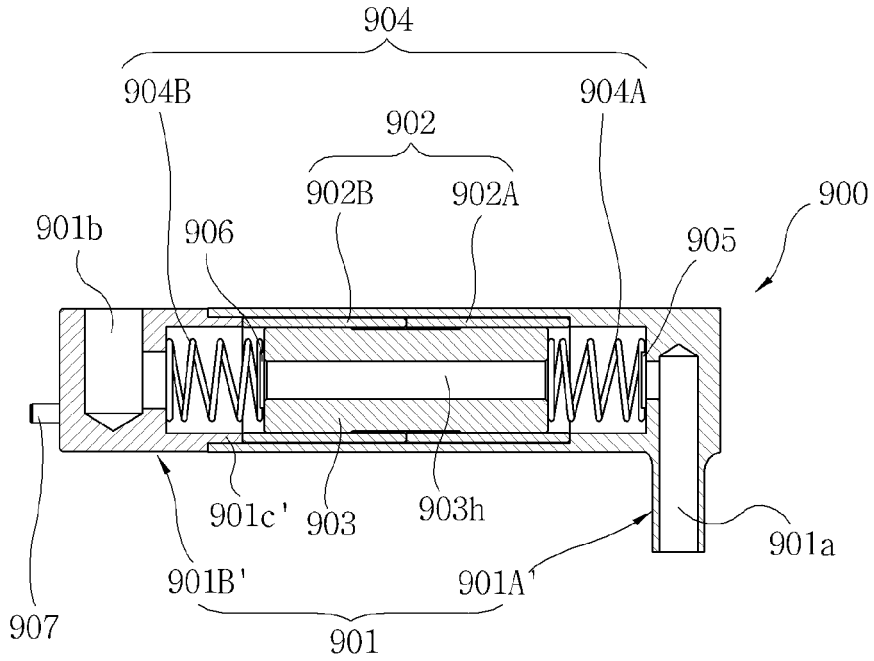
FIG. 8 illustrates another example of an oil feed assembly for a linear compressor in accordance with the present invention.

FIG. 8 illustrates another example of an oil feed assembly in a linear compressor in accordance with the present invention. Similar to the previous example discussed earlier, an oil feed assembly 900 of this example is manufactured in kit form, providing a plastic casing 901 to accommodate a friction member 902, a piston 903, a pair of oil springs 904, an oil suction valve 905, and an oil discharge valve 906 inside. For the casing 901, a separately manufactured casing body and a discharge pipe are assembled to each other.

That is, a cylindrical casing body 901A' having an inlet 901*a* and a discharge pipe 901B' having an oil discharge outlet 901*b* are manufactured separately, and then a friction member 902, a piston 903, oil springs 904, an oil suction valve 905, and an oil discharge valve 906 are built in the casing body 901A'. After that, the discharge pipe 901B' having the outlet 901*b* is communicably assembled to the casing body 901A'. At this time, the casing body 901A' has a stepped structure with an increasing inner diameter on one end, and the discharge pipe 901B' to be coupled therewith also has a stepped structure with a decreasing outer diameter on one end. As such, the casing body 901A' and the discharge pipe 901B' are press-fit together and assembled to each other in the axial direction.

Meanwhile, the casing 901 can take a variety of forms, to which at least two injection-molded members can be coupled.

Figure 9:
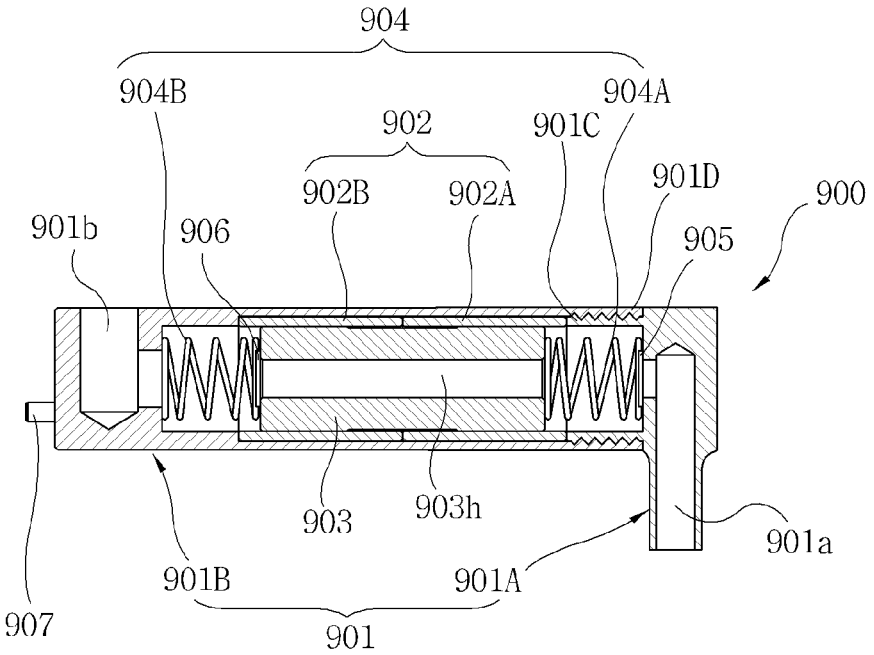
FIGS. 9 and 10 each illustrate a diverse assembly of casing of an oil feed assembly for a linear compressor in accordance with the present invention.
Figure 10:
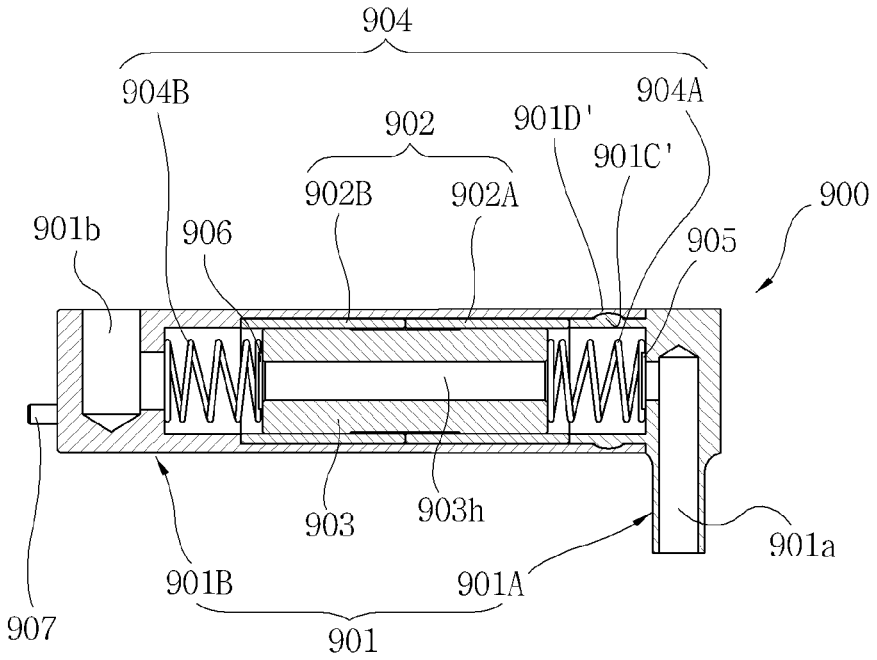

FIG. 9 and FIG. 10 each illustrate a diverse assembly of casing of an oil feed assembly for a linear compressor in accordance with the present invention. Similar to the oil feed assembly in FIG. 7, first and second members 901A and 901B are screwed in an axial direction to build a casing 901, where a male thread 901C provided to the outer circumference of the first member 901A and a female thread 901D provided to the inner circumference of the second member 901B are engagedly attached to the casing 901. The first and second members 901A and 901B each have a cylindrical shape in their joint area. The outer diameter of the first member 901A coincides with the inner diameter of the second member 901B, so the first member 901B is twisted (screwed) into the second member 901B. Meanwhile, in accordance with yet another assembly example for the oil feed assembly shown in FIG. 10, first and second members 901A and 901B kiss in an axial direction to build a casing 901, where a mounting protrusion 901C' that is protruded in the circumference direction on the outer circumference of the first member 901A and a mounting groove 901D' that is recessed in the circumference direction on the inner circumference of the second member 901B are engagedly attached to the casing 901. The first and second members 901A and 901B each have a cylindrical shape in their joint area. The outer diameter of the first member 901A coincides with the inner diameter of the second member 901B, so the first member 901B is axially compressively fitted into the second member 901B.

Meanwhile, the casing 901 can take a variety of forms, to which at least two injection-molded members can be coupled.

Figure 11:
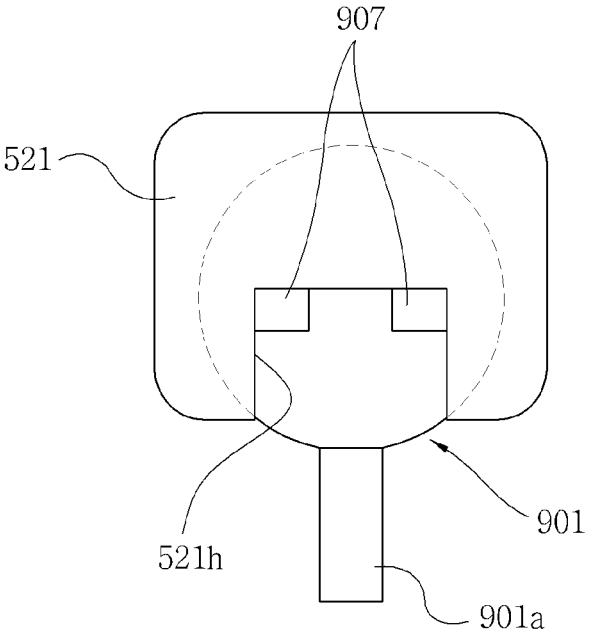
FIG. 11 illustrates one example of an anti-rotation structure of an oil feed assembly for a linear compressor in accordance with the present invention.

FIG. 11 illustrates one example of an anti-rotation structure for an oil feed assembly in a linear compressor of the present invention. Such an oil feed assembly further includes an anti-rotation means to prevent the wrong assembly and to impede (prevent) the rotation at the same time. Referring FIGS. 4 and 11, a pair of anti-rotation protrusions 907 is formed in an axially direction with a predetermined spacing therebetween on one end of the casing 901 of the oil feed assembly 900 that is inserted into the mounting groove 521 of the frame 520. Also, anti-rotation holes 521*h* are formed in the mounting groove 521 of the frame 520, into which the anti-rotation protrusions 907 are inserted. It does not matter whether one relatively large anti-rotation hole 521*h* is formed to receive both ends of the anti-rotation protrusions 907, or two anti-rotation holes 521*h* are formed to receive the anti-rotation protrusions 907, respectively.

With reference to FIGS. 4 and 11, the following will now explain how the oil feed assembly is assembled.

The oil feed assembly 900 is supportably installed in the axial direction between the frame 520 and the motor cover 540. That is, one end of the casing 901 of the oil feed assembly 900 is inserted into the mounting groove 521 that is formed in a lower portion of the frame 520, and the anti-rotation protrusions 907 of the oil feed assembly 900 are inserted into the anti-rotation holes 521*h* that are formed in the mounting groove 521, thereby preventing the wrong assembly of the oil feed assembly 900. Meanwhile, the other end of the casing 901 of the oil feed assembly 900 is held against the motor cover 540, and the motor cover 540 is bolted to the frame 520.

Besides, an elastic member such as leaf spring can be added between the mounting groove 521 of the frame 520 and the oil feed assembly 900, so as to increase the fastening force of the oil feed assembly 900 in the axial direction for the prevention of a possible dislocation due to vibrations or external shock. Even if the plastic casing 901 of the oil feed assembly 900 may experience the size change or thermal deformation, the elastic member ensures that the oil feed assembly 900 is not dislocated from between the frame 520 and the motor cover 540. In the case of installing an additional elastic member, the elastic member preferably has holes or grooves (not shown) to allow the anti-rotation protrusions 907 on the side of the oil feed assembly 900 to pass through the elastic member and eventually settle in the anti-rotation holes 521*h* in the mounting groove 521.

With reference to FIGS. 4 and 5, the following will now explain about an operation of the oil feed assembly.

When the piston 300 linearly reciprocates, vibrations that are produced in result of the linear-reciprocating motion of the piston 300 are transferred via the cylinder 200, the frame 520, and the motor cover 540 eventually to the oil feed assembly 900. By the vibrations, the oil piston 903 inside the casing 901 starts reciprocating linearly, and this in turn results in a pressure difference inside the casing 901. Thus, the oil at the bottom of the shell 110 is pumped up and supplied through the inlet 901*a* of the casing 901. When the oil suction valve 905 is opened, the oil having been introduced through the inlet 901*a* of the casing 901 passes through the inner space of the casing 901 and the hole 903*h* of the oil piston 903. On the other hand, when the oil discharge valve 906 is opened, the oil having passed through the hole 903*h* of the oil piston 903 travels through the inner space of the casing 901 and the outlet 901*b* to be supplied following the oil supply path 520in. The thusly supplied oil along the oil supply path 520in is introduced between the cylinder 200 and the piston 300 to lubricate and cool them, and is collected again down to the bottom of the shell 110 through the oil recovery path 520out.

The present invention has been described in detail with reference to the embodiments and the attached drawings. However, the scope of the present invention is not limited to the embodiments and the drawings, but defined by the appended claims.

The invention claimed is:

1. A linear compressor, comprising:

a cylinder having a refrigerant compression space inside;

a piston that linearly reciprocates inside the cylinder to compress a refrigerant;

a frame, to which one end of the cylinder is fixed and which has a mounting groove at a lower portion thereof;

an oil feed assembly settled in the mounting groove of the frame, that pumps and supplies oil;

an oil supply path in a linear shape, which is positioned at a lower portion inside the frame to communicate with the mounting groove of the frame and with a bottom of the cylinder and which supplies the oil between the cylinder and the piston; and an oil recovery path in a linear shape, which is positioned at an upper portion inside the frame asymmetrical to the oil supply path to communicate with an upper side of the frame and with a top of the cylinder and which recovers the oil between the cylinder and piston, wherein the oil supply path is greater in diameter than the oil recovery path.

2. The linear compressor of claim 1, wherein the oil feed assembly includes an inlet path, an internal space path, and an outlet path, which are interconnected to each other and bent at joints so that an outlet of the oil feed assembly is opened at an upper side facing the cylinder, and wherein the outlet communicates with the oil supply path, when the oil feed assembly is positioned in the mounting groove of the frame.

3. The linear compressor of claim 1, wherein an angle between the oil supply path and a central axis of the cylinder is greater than an angle between the oil recovery path and the central axis of the cylinder.

4. The linear compressor of claim 1, wherein the oil recovery path is shorter in length than the oil supply path.

5. The linear compressor of claim 1, wherein the oil feed assembly includes:

an oil piston, which has a penetrating axial oil path and which pumps oil while making a linear-reciprocating motion;

first and second oil springs that elastically support both ends of the oil piston in an axial direction; and a casing, which has a first member with an inlet through which the oil is introduced and a second member with an outlet through which the oil is discharged, the first and second members being assembled to communicate with each other in a state in which the oil piston and the first and second oil springs are provided in the first and second members.

6. The linear compressor of claim 5, wherein the first and second members are assembled in an axial direction.

7. The linear compressor of claim 5, wherein one of the first and second members has a male thread on an outer circumference thereof, and the other of the first and second members has a female thread on an inner circumference thereof to be engagedly coupled with the male thread.

8. The linear compressor of claim 5, wherein one of the first and second members has a mounting protrusion on an outer circumference thereof, and the other of the first and second members has a mounting groove on an inner circumference thereof to be engaged with the mounting protrusion.

9. The linear compressor of claim 5, wherein the first and second members are made of plastic materials.

10. The linear compressor of claim 5, wherein the oil feed assembly further includes:

a friction member fixed to an inner circumference of the casing, that reduces friction and abrasion of the casing against the linear reciprocating motion of the oil piston therein.

11. The linear compressor of claim 5, wherein the oil piston has friction-decreasing grooves formed in one section of an outer circumference of the oil piston, so as to reduce a contact area with the casing during the linear reciprocating motion.

12. The linear compressor of claim 1, wherein the oil feed assembly includes:

a plastic casing, which has an inlet and an outlet on both sides that introduce and discharge the oil therethrough, respectively;

an oil piston, which has a penetrating axial oil path and pumps the oil while reciprocating inside the casing;

first and second oil springs that elastically support both ends of the oil piston on an inside of the inlet and the outlet of the casing; and a friction member fixed to an inner circumference of the casing that reduces friction and abrasion, of the casing against the linear reciprocating motion of the oil piston therein.

13. The linear compressor of claim 12, wherein the casing has a first member with the inlet through which oil is introduced and a second member with the outlet through which oil is discharged, the first and second members being assembled to communicate with each other in a state in which the oil piston and the first and second oil springs are provided in the first and second members.

14. The linear compressor of claim 13, wherein the first and second members are assembled in an axial direction.

15. The linear compressor of claim 13, wherein one of the first and second members has a male thread on an outer circumference thereof, and the other of the first and second members has a female thread on an inner circumference thereof to be engaged with the male thread.

16. The linear compressor of claim 13, wherein one of the first and second members has a mounting protrusion on an outer circumference thereof, and the other of the first and second members has a mounting groove on an inner circumference thereof to be engageably coupled with the mounting protrusion.

17. The linear compressor of claim 12, wherein the oil piston has friction-decreasing grooves formed in one section of an outer circumference thereof, so as to reduce a contact area with the casing during the linear reciprocating motion.

18. The linear compressor of claim 1, wherein the oil feed assembly includes:

a casing made of a plastic material, which includes a first member with an inlet through which the oil is introduced and a second member with an outlet through which the oil is discharged, the first and second members being assembled to each other;

an oil piston made of a metallic material, that pumps oil while making a linear-reciprocating motion and which has a penetrating axial oil path and;

first and second oil springs that elastically support both ends of the oil piston on an inside of the inlet and the outlet of the casing;

an oil suction valve in sheet metal form, which is elastically supported by the first oil spring to open or close the inlet of the casing;

an oil discharge valve in sheet metal form, which is elastically supported by the second oil spring to open or close the outlet of the casing; and a friction member fixed to an inner circumference of the casing, that reduces friction and abrasion of the casing against the linear reciprocating motion of the oil piston therein.

* * * * *